US006226023B1

(12) United States Patent
No

(10) Patent No.: US 6,226,023 B1
(45) Date of Patent: May 1, 2001

(54) THERMAL PRINTING MEDIA PACK

(75) Inventor: Young No, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/307,946

(22) Filed: May 10, 1999

(51) Int. Cl.[7] ..... B41J 32/00
(52) U.S. Cl. ..... 347/214; 347/215
(58) Field of Search ..... 347/217, 214, 347/171, 215; 400/207–208, 238

(56) References Cited

U.S. PATENT DOCUMENTS 5,519,428 5/1996 Van Peteghem .
5,605,403 2/1997 Vegeais et al. .
5,727,883 * 3/1998 Kusano et al. ..... 400/208
5,936,654 * 8/1999 Yokoyama et al. ..... 347/217
6,057,870 * 5/2000 Monnier et al. ..... 347/171

FOREIGN PATENT DOCUMENTS 0 352 032 A2 1/1990 (EP) .

* cited by examiner

*Primary Examiner*—N. Le
*Assistant Examiner*—K. Feggins
(74) *Attorney, Agent, or Firm*—Thomas H. Close

(57) ABSTRACT

A thermal print media pack for a thermal printer includes a housing; a roll of thermal print receiver media arranged in the housing; and a roll of thermal dye carrier media arranged in the housing, the thermal dye carrier media having a heat transferable dye on a relatively thin base web including a repeating series of spaced apart frames of different colored dyes and a relatively thicker leader attached to the leading edge of the relatively thin base web.

10 Claims, 3 Drawing Sheets

THERMAL PRINTING MEDIA PACK

FIELD OF THE INVENTION

The present invention relates to a media pack for a thermal printer, and more particularly to a media pack containing both a thermal dye carrier web and a thermal dye receiver web.

BACKGROUND OF THE INVENTION

In a typical thermal printer, a web-type dye carrier containing a repeating series of spaced frames of different colored heat transferable dyes is spooled on a supply spool. The carrier is paid out from the supply spool and rewound on a take-up spool. The carrier moves through a nip formed between a thermal print head and a dye-absorbing receiver. The receiver in turn is supported by a platen. The print head engages the dye-carrier and presses it against the receiver. The receiver may, for example, be coated paper and the print head is formed of, for example, a plurality of heating elements. When a particular heating element is energized, it is heated. In the presence of heat and pressure, dye from the carrier is caused to transfer to the dye-received. The density or darkness of the printed color dye is a function of the energy delivered from the heating element to the carrier.

The web-type carrier often includes a repeating series of spaced yellow, magenta and cyan dye frames. The carrier is typically formed of a very thin, flexible dye carrying web having a thickness that can be on the order of one fourth mil. Both the supply and the take-spool for the dye carrier web are typically mounted in a cartridge. Even though the carrier is very thin and has no beam strength, positioning and handling the dye carrier web in a printer with such a cartridge is not a problem since both ends of the carrier are already wound on the supply and take-up spool.

The dye-absorbing receiver may be supplied as a package of pre-cut sheets of coated paper which are fed into the printing nip by a paper pick and transport system. In some thermal printers, a roll of receiver media is used to supply the dye-receiver rather than a pre-cut sheet of dye-receiver in order to reduce the media manufacturing cost. In such a system, an image is printed on the dye-receiver that is still attached to the roll and the receiver is cut from the supply roll after each image is printed. The supply roll pays out the receiver for each color, then rewinds it back up before the next color.

A printing system that utilizes the separate dye carrier and receiver packs for the thermal printing media has several drawbacks. First, the printing apparatus tends to be overly complex since the system requires separate mechanisms to handle the media, one mechanism to handle the dye carrier and another to transport the receiver. Second, in addition to the increased inconvenience to the customer, there are greater chances to mishandle the media and damage the printer since one has to handle the media twice; once to load the dye carrier and once to load the receiver. Some receivers require special dye carriers, receiver media combinations for unique image printing. If the media in the printer comes in two separate packages, there is a possibility that one could mismatch media and ruin the uniqueness of the print.

European Patent Application No. 0 487 314 Published 27.05.92 by Collins shows a cassette for thermal printer that prints a single color of ink on a narrow ribbon. The cassette includes an ink ribbon wound on a supply spool and received on a take up spool in the cassette. The cassette also includes a roll of ink receiving tape. A problem with such a design is that the cartridge becomes quite large, particularly for full color thermal printing in wide formats, thereby increasing the cost of packaging, storage and handling of the media cassette.

There is a need therefore for an improved media pack of a color thermal printer.

SUMMARY OF THE INVENTION

The above mentioned need is met according to the present invention by providing a thermal print media pack for a thermal printer including a housing; a roll of thermal print receiver media arranged in the housing; and a roll of thermal dye carrier media arranged in the housing, the thermal dye carrier media having a heat transferable dye on a relatively thin base web and a relatively thicker leader attached to the leading edge of the relatively thin base web. In a preferred embodiment of the invention, the print receiver media is arranged in the pack such that the receiver is bent in an opposite direction to the core set of the roll in exiting from the pack, thereby reducing the curl of the resulting thermal print.

The thermal media pack of the present invention has the advantages that the dye carrier and the print receiver are contained in the same pack, thereby simplifying the loading of the media and allowing a simplification of the apparatus. The print receiver media is contained on a roll, and no take up spool is provided for the dye carrier web, thereby minimizing the size and reducing the manufacturing costs of the media pack. The thermal media pack also has the advantage that the dye carrier can be rewound into the pack after use, and the pack returned for recycling.

DETAILED DESCRIPTION OF THE INVENTION

Figure 1:
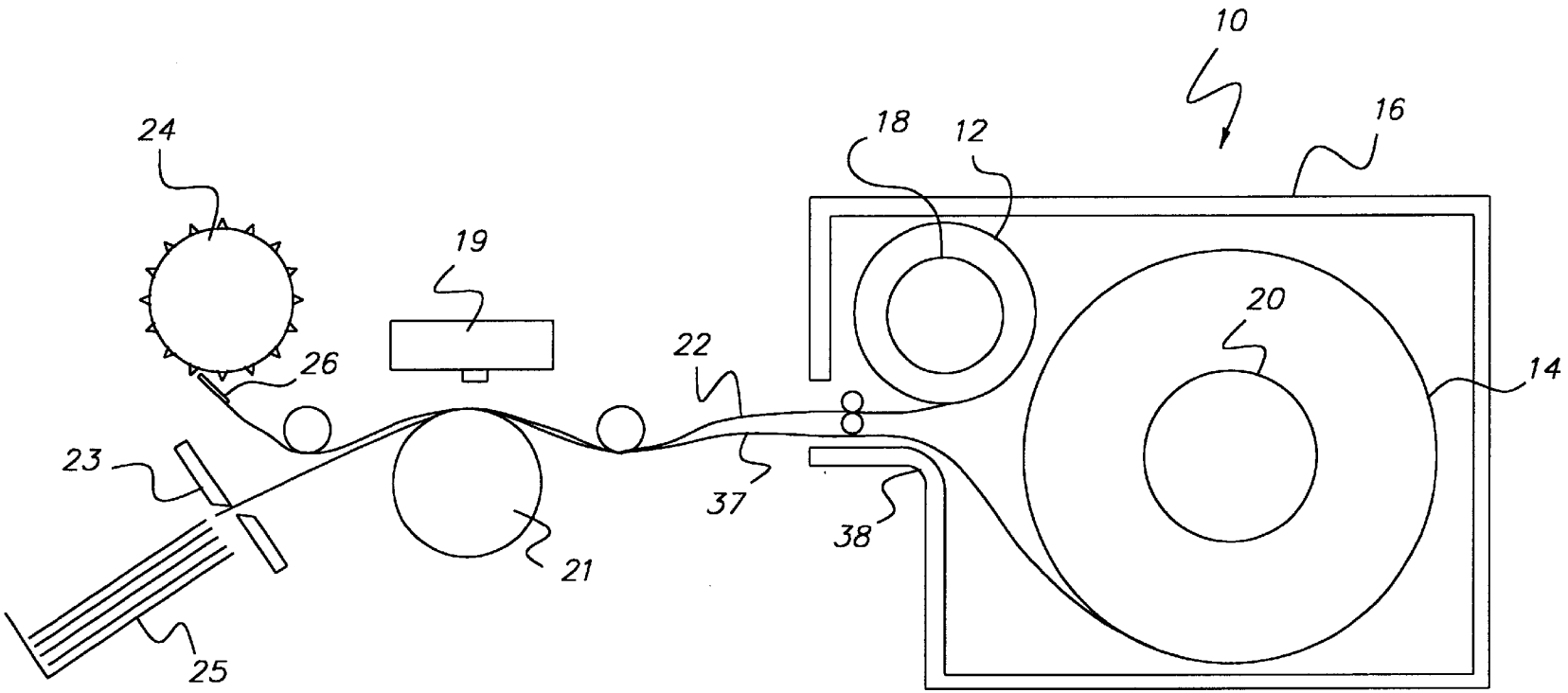
FIG. 1 is a schematic diagram illustrating the cross section of a color thermal print media pack according to the present invention.
Figure 2:
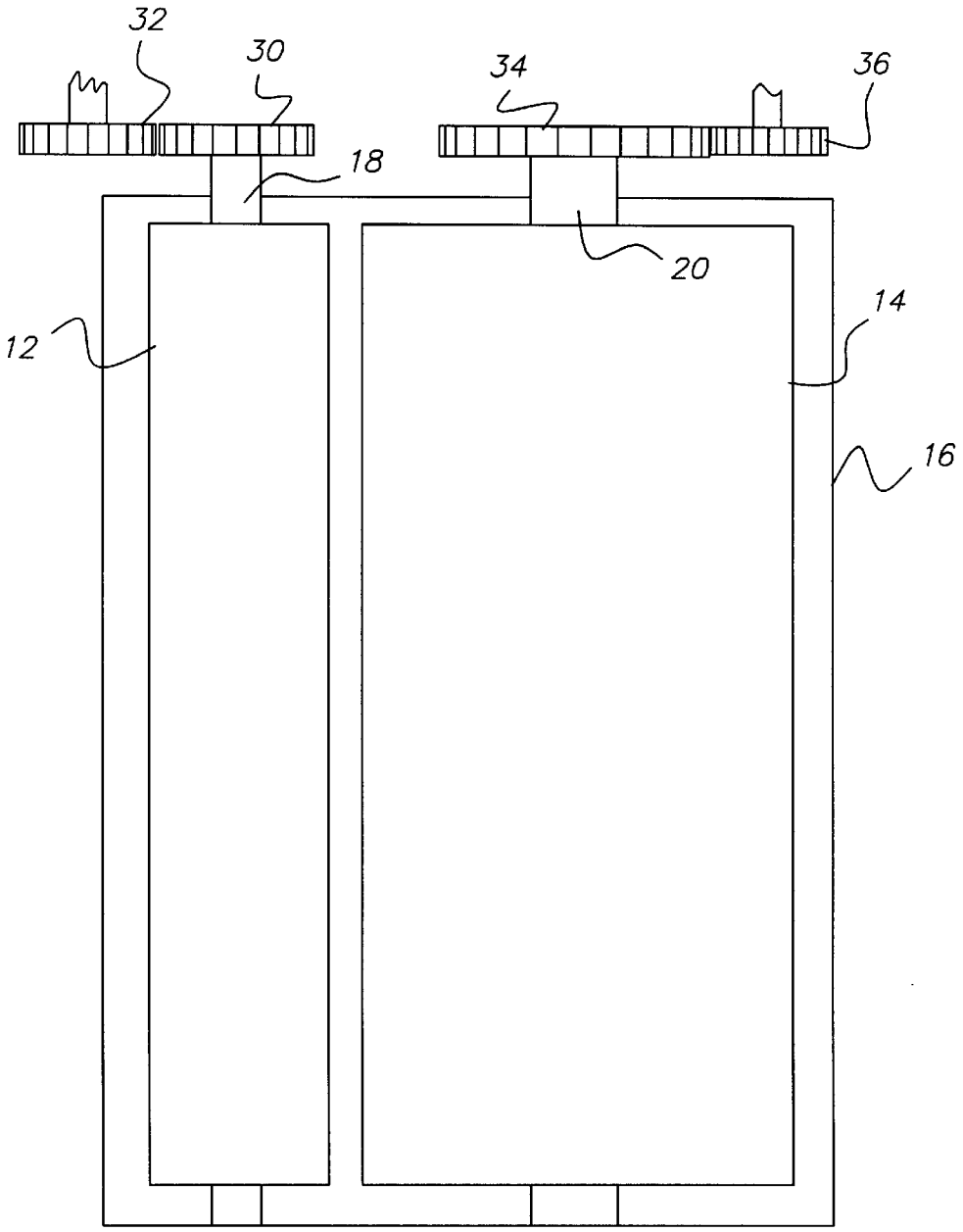
FIG. 2 is a schematic diagram illustrating a top view of the color thermal print media pack shown in FIG. 1.

Referring to FIGS. 1 and 2, the present invention provides a compact integrated thermal print media pack, generally designated 10, which includes both a roll of dye carrier 12 and a roll of print receiver 14. To simplify media handling, both the dye carrier 12 and the print receiver 14 are contained in a single housing 16. To reduce thermal media manufacturing cost, no dye carrier take-up spool is provided in the housing 16. According to a preferred embodiment, the roll of dye carrier media 12 is carried on a spool 18, which is mounted for rotation within the housing 16, and the roll of print receiving media 14 is carried on a spool 20, similarly mounted for rotation within housing 16.

FIG. 1 shows a side view of the media pack 10, and FIG. 2 a top view. As noted, the media pack 10 contains only a supply spool 18 for the roll of dye carrier 12, and not a take up spool. The dye carrier medium and the print receiving medium are transported in a thermal printer apparatus past a print head 19 and a print platen 21. Completed prints are cut from the roll by a chopping knife 23 and deposited in a tray 25.

Figure 3:
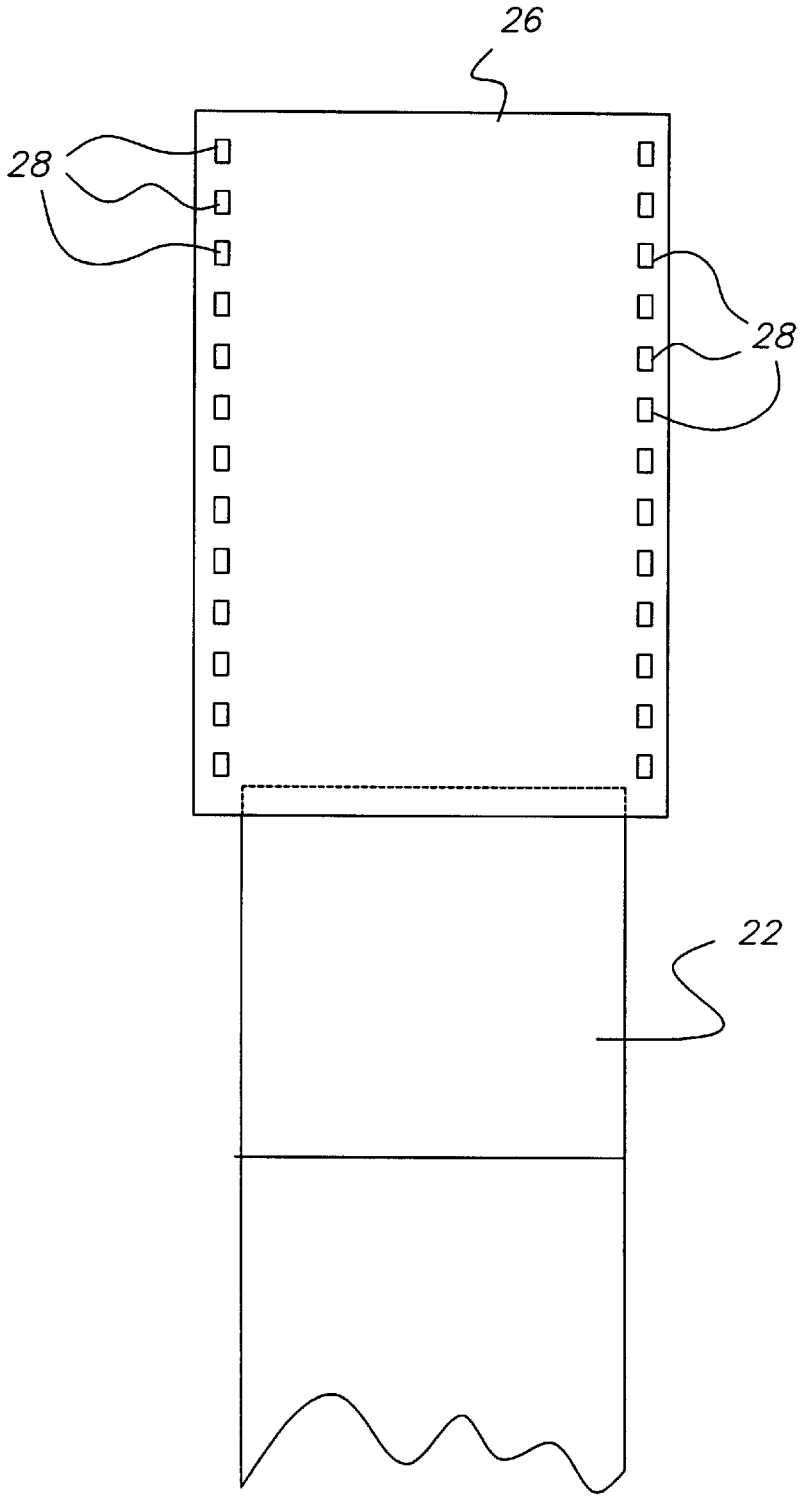
FIG. 3 is a top view showing the leader attached to the dye carrier web according to the present invention.

Referring to FIG. 3, to aid in removing the very thin, flexible dye carrier web 22 from the housing 16 and thread the web 22 through a thermal printer to a take up spool 24 in the ink jet printer, a thicker carrier leader 26 is attached to the leading end of the dye carrier web. The carrier leader is, for example, 20 $\mu$m thick. The carrier leader 26 is transported to the take-up spool 24 which is now an integral part of the thermal printer.

In a preferred embodiment of the invention, the carrier leader 26 is provided with edge perforations 28, for cooperation with toothed rollers in the printer for threading the leader. When the leading edge of the carrier leader 26 reaches the take-up spool 24, the sprockets of the take-up spool catch the leader and starts to wind the carrier on the take-up spool. To simplify loading a new media pack, the used dye carrier 22 can be rewound to the supply spool when all the receiver media in the media pack has been consumed. To enable rewinding of the dye carrier into the media pack 10, the spool 18 is provided with a gear 30, which extends beyond the housing 16 and is accessible by a driving gear 32 in the printer.

The print receiver spool 20 is provided with a gear 34 attached to the spool 20 and accessible outside of housing 16 by a drive gear 36, which is part of the printer, for driving the print receiving media 37 out of the housing 16. Referring to FIG. 1, the roll of print receiving media 14 is arranged in housing 16, and housing 16 is provided with a feature 38, such that the print receiving media is bent upon exiting the housing 16 in a direction opposite to the curl of the media 37 on the roll 14, thereby reducing the curl of the resulting print.

The invention has been described in detail with particular reference to certain preferred embodiments thereof, but it will be understood that variations and modifications can be effected within the spirit and scope of the invention.

| PARTS LIST | |
|---|---|
| 10 | thermal print media pack |
| 12 | roll of dye carrier medium |
| 14 | roll of print receiver medium |
| 16 | housing |
| 18 | spool |
| 19 | print head |
| 20 | spool |
| 21 | print platen |
| 22 | carrier web |
| 23 | chopping knife |
| 24 | take-up spool |
| 25 | tray |
| 26 | dye carrier web |
| 28 | edge perforations |
| 30 | dye carrier spool gear |
| 32 | drive gear |
| 34 | print receiver spool gear |
| 36 | drive gear |
| 37 | print receiving media |
| 38 | media bending feature |

What is claimed is:

1. A color thermal print media pack for a thermal printer, comprising:

a) a thermal print media pack housing;

b) a roll of thermal print receiver media arranged in the housing; and c) a roll of thermal dye carrier media arranged in the housing, the thermal dye carrier media having a heat transferable dye on a base web including a repeating series of spaced apart frames of different colored dyes and a leader attached to the leading edge of the base web, the leader being thicker than the base web.

2. The thermal print media pack claimed in claim 1, wherein the leader defines edge perforations for cooperating with a toothed take-up spool in the thermal printer.

3. The thermal print media pack claimed in claim 1, wherein the roll of thermal dye carrier media is carried on a spool mounted for rotation in the housing, and further comprising a gear connected to the spool and accessible outside of the housing for rewinding the thermal dye carrier media onto the spool after all of the media has been used.

4. The thermal print media pack claimed in claim 1, wherein the roll of thermal print receiver media is carried on a spool mounted for rotation in the housing, and further comprising a gear connected to the spool and accessible outside of the housing for driving the thermal print receiver media from the housing onto a printer platen in the thermal printer.

5. The thermal print media pack claimed in claim 1, wherein the housing includes a feature to cause the thermal print receiver media to bend in a direction opposite to the curl of the receiver media on the roll, thereby reducing the curl of the thermal print.

6. A method of handling thermal print media in a thermal printer, comprising the steps of:

a) providing a thermal print media pack having a housing, a roll of thermal print receiver media arranged in the housing, and a roll of thermal dye carrier media arranged in the housing, the thermal dye carrier media having a heat transferable dye on a base web including a repeating series of spaced apart frames of different colored dyes and a leader attached to the leading edge of the base web, the leader being thicker than the base web;

b) placing the thermal print media pack into the thermal printer;

c) winding the thermal dye carrier onto a take-up spool located in the printer using the leader; and d) removing a length of thermal print receiving media from the housing and passing it repeatedly past a thermal print head in the thermal printer to print overlapping images of the different colored dyes to produce a color image on the print receiving media.

7. The method claimed in claim 6, wherein the leader defines edge perforations for cooperating with a toothed take-up spool in the thermal printer.

8. The method claimed in claim 6, wherein the roll of thermal dye carrier media is carried on a spool mounted for rotation in the housing, a gear being connected to the spool and accessible outside of the housing, and further comprising the step of rewinding the thermal dye carrier media onto the spool after all of the media has been used.

9. The method claimed in claim 6, wherein the roll of thermal print receiver is carried on a spool mounted for rotation in the housing with a gear connected to the spool and accessible outside of the housing and further comprising the step of driving the thermal print receiver media from the housing by driving a gear attached to a spool on which the print receiver media is wound.

10. The method claimed in claim 6, including the step of causing the thermal print receiver media to bend in a direction opposite to the curl of the receiver media on the roll, thereby reducing the curl of the thermal print.

* * * * *